US005476545A

United States Patent [19]

Schrauwers et al.

[11] Patent Number: 5,476,545

[45] Date of Patent: Dec. 19, 1995

[54] ROTARY CERAMIC TILE GLAZING AND DECORATING MACHINE

[75] Inventors: Carel Schrauwers, Bergen, Netherlands; Mario Schianchi, Sassuolo, Italy

[73] Assignees: Stork X-cel B.V., Boxmeer, Netherlands; T.S.C. S.r.l., Fiorano Modenese, Italy

[21] Appl. No.: 301,973

[22] Filed: Sep. 7, 1994

[30] Foreign Application Priority Data

Sep. 10, 1993 [IT] Italy ..... MO93A0115

[51] Int. Cl.[6] ..... B05C 1/08

[52] U.S. Cl. ..... 118/668; 118/203; 118/239; 118/244; 118/252; 118/676; 118/679; 118/686; 118/712

[58] Field of Search ..... 118/203, 210, 118/239, 244, 252, 668, 676, 679, 686, 712; 427/8, 428; 198/604, 606, 626.1

[56] References Cited

U.S. PATENT DOCUMENTS

| | | | |
|---|---|---|---|
| 1,035,959 | 8/1912 | Goldsmith | 427/428 |
| 3,155,541 | 11/1964 | Jackson | 118/203 |
| 3,510,374 | 5/1970 | Walker | 118/712 |
| 4,267,209 | 5/1981 | Hanson | 427/199 |
| 4,287,849 | 9/1981 | Walchhuetter | 118/239 |
| 5,090,557 | 2/1992 | Carmen | 198/626.1 |

FOREIGN PATENT DOCUMENTS

| | | | |
|---|---|---|---|
| 0342953 | 9/1904 | France . | |
| 1575869 | 7/1969 | France . | |
| 2262599 | 9/1975 | France . | |
| 1083691 | 4/1986 | Japan | 118/239 |
| 4116013 | 4/1992 | Japan | 198/604 |
| 9201144 | 1/1994 | Netherlands . | |
| 2053824 | 2/1981 | United Kingdom . | |

*Primary Examiner*—Laura Collins
*Attorney, Agent, or Firm*—Browdy and Neimark

[57] ABSTRACT

The machine employs a rotary apparatus comprising a matrix-bearing cylinder coupled on an underlying transfer cylinder contacting over at least a tract of external surface thereof with an upper surface of a tile transiting on a rest plane. The tile is gripped between two facing branches of two lateral belts which advance the tile below the transfer cylinder; the rotation of the transfer cylinder being synchronized with the translation of the tile moved by the branches.

7 Claims, 1 Drawing Sheet

ROTARY CERAMIC TILE GLAZING AND DECORATING MACHINE

BACKGROUND OF THE INVENTION

The invention relates to a rotary ceramic tile glazing and decorating machine. The prior art teaches such machines wherein the decoration of the tiles is effected by means of a transfer system, widely used in printing, where the pattern is engraved on a chalcographic drum, which is first supplied with glaze and when rotating contacts an underlying and also-rotating intermediate transfer roller. The underlying roller is in direct contact with the tile and transfers thereto the pattern originating from the engraved drum. A horizontal conveyor advances the tiles, which are then pushed under the intermediate transfer roller, which latter is covered in rubber so as to exhibit a slight elastic deformability in order to adjust to small breadth differences between the various tiles passing thereunder. A support roller, positioned below the intermediate roller, compresses the tile (with a predetermined pressure) against the intermediate roller during the printing phase. An apparatus of this type is described in European Publication no. 278650.

Also disclosed in the prior art is the use of silk screens for decorating tiles, wherein the transfer of the glaze on to the tiles is performed through the cylindrical surface of the screen, which rolls on the tile. The glaze inside the screen is pushed outwards by spatula devices.

All the illustrated embodiments, both indirect (with the presence of an intermediate transfer roller) and direct (using a rotary silk screen) present numerous drawbacks which render them useful only in a small number of applications. In particular, they are used almost exclusively in decorations reproducing, for example, veined stone or marble effects and the like.

Finally, the prior art solutions do not afford constant results, as it is impossible to obtain multicolored patterns of an acceptable quality, that is of a quality which can be obtained using traditional flat and single-color dedicated silk screens.

A further common drawback in the prior art applications, especially those wherein the decoration is performed by indirect transfer of the image, is that it is difficult to achieve a perfect cleaning operation on the transfer roller, and therefore guarantee a perfect reproduction of the pattern on the tile.

With regard in particular to rotary silk screen apparatus, further drawbacks are inherent in relation to the structure of the screen itself, which includes internal ribbing.

SUMMARY OF THE INVENTION

The present invention, as it is characterized in the claims that follow, obviates the drawbacks in the prior art by providing a rotary glazing and decorating machine which, while reaching high qualitative levels corresponding at least to the levels of traditional flat silk screening machines, is also able to work at a faster rate. One advantage provided by the present invention is its versatility which contributes to its great economy of use, both as a tile decorator and as a simple glazer: only the matrix-bearing drum has to be substituted for each operation.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

Figure 1:
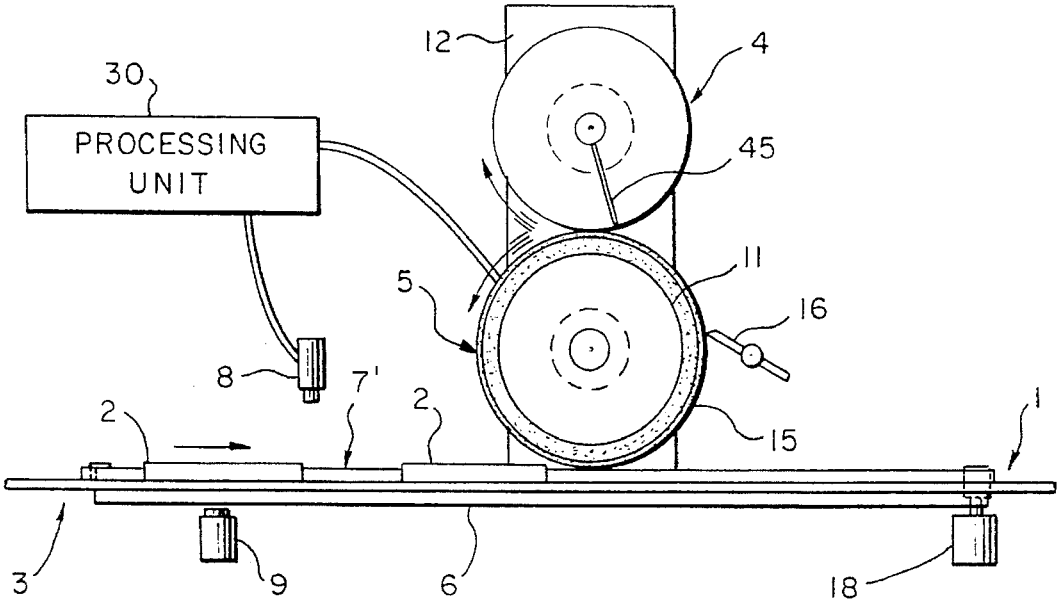
FIG. 1 is a schematic section made according to line II—II of FIG. 2.

DESCRIPTION OF THE PREFERRED EMBODIMENTS.

With reference to the drawings, 1 denotes a horizontal rest plane transporting tiles 2 towards a decoration or glazing process. The rest plane 1 is in line with a common belt-type tile conveyor 3. The tile conveyor belts 3 drag on fixed guide rails 6 which support the tile conveyor 3. A rotary glazing and decorating machine is positioned above the rest plane 1 and comprises a matrix-bearing cylinder 4 coupled on an underlying transfer cylinder 5 predisposed to contact (with at least a part of its external surface) the upper surface of the transiting tiles 2 on the rest plane 1. The matrix-bearing cylinder 4, supported like the transfer cylinder 5 on a frame 12, is constituted by a cylindrical silk screen, free of welding and internal ribbing, and provided with a special 45 device operating internally of the screen to press and direct the glaze towards the external surface of the transfer cylinder 5. The transfer cylinder 5 is constituted by a roller which externally exhibits a thin wear-resistant teflon (or the like) coating 15, stretched on an underlying and thicker layer of elastomer 11 exhibiting a softer consistency than that of the coating 15. The transfer cylinder 5 is thus deformable, so that it adheres well to the upper surface of the tiles 2, obviating in this way any problems due to small differences in tile breadth and imperfections on the tile surfaces. The two cylinders 4 and 5 are connected in rotation by gearings, so that in the contact zone therebetween no dragging can occur. In the present embodiment, the transfer cylinder 5 is driven by a step-by-step motor 14 and is provided with an angle-position sensor 10 having the task of continuously reading the position of a predetermined point of the cylinder with respect to a fixed reference.

The cleanliness of the external surface of the transfer cylinder 5 is guaranteed by a doctor 16 which is kept pressed against the external cylindrical surface and alternates parallel to the rotation axis of the cylinder. Thus the external surface of the transfer cylinder 5 is freed of any residual glaze before coming into contact with the external cylindrical surface of the matrix-bearing cylinder 4 and receiving fresh glaze.

The silk screen of the matrix-bearing cylinder 4 can exhibit several images distributed over its surface, corresponding to various different decorations to be applied on different tiles 2.

The tiles 2 are brought under the transfer cylinder 5 by a gripping and transport device situated above the rest plane 1 bearing the tiles 2, and operates by gripping the tiles 2 at their opposite edges (the diametrically opposite edges with respect to the advancement direction of the tiles 2). The gripping device comprises two ringed cogged belts 7 and 7' coupled on cogged pulleys 19 driven by step-by-step motors 18. The two belts 7 and 7' function as two facing branches 17 and 17' contacting and acting on the opposite lateral sides of the tiles 2. The drive transmission of the two belts 7 and 7' is such that the two branches 17 and 17' are drive- and speed-synchronised in the advancement direction. For a perfect transversal centering, the branch 17' runs on a fixed reference guide 20 while branch 17 is kept elastically pressed against the edge of the tile 2.

Figure 2:
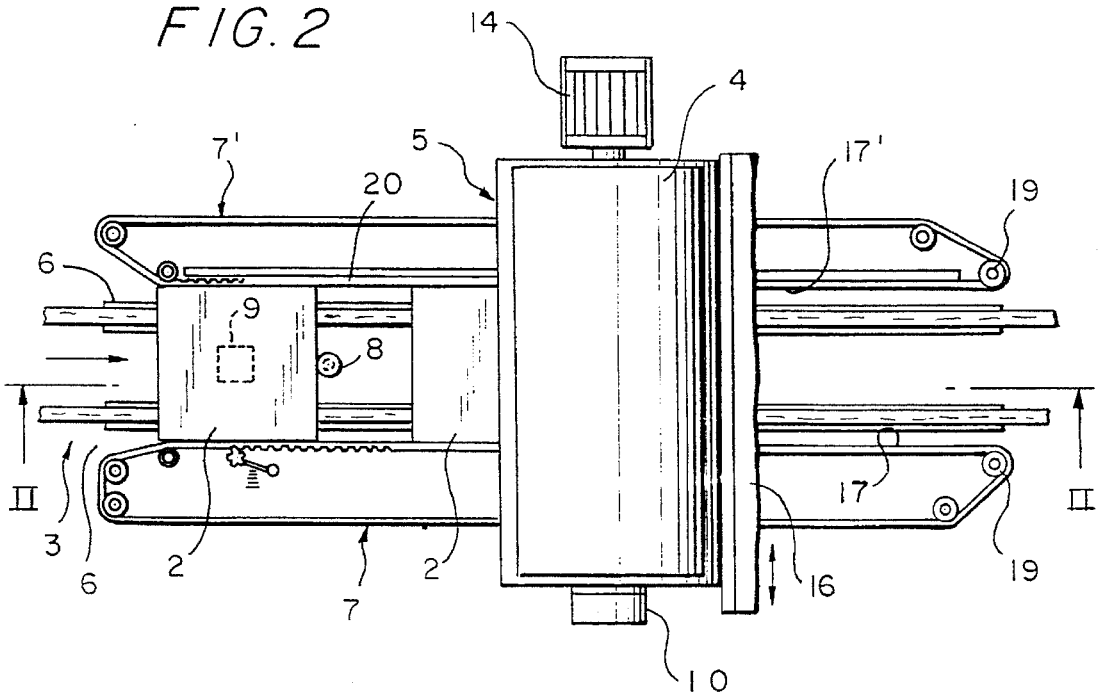
FIG. 2 is a schematic plan view from above of FIG. 1.

A sensor 8, constituted in the embodiment by a photocell, is arranged at the entrance of the branches 17 and 17' and has the specific function of signalling a predetermined positioning (the sensor is fixed) of a tile 2 on the rest plane 1, gripped between the two branches 17 and 17' with respect to the position of the transfer cylinder 5. The signal emitted by the sensor 8 is sent to a processing unit 30 which automatically governs the machine according to a preset program. The processing unit 30 is schematically shown in FIG. 1 connected between the sensor 8 and the drive of the transfer cylinder 5. The processing unit 30 is omitted in FIG. 2 for clarity.

In proximity of the entrance to the branches 17 and 17', a code reading device 9 reads off an identification code provided on each single tile 2 as the tile 2 reaches the machine. The code is impressed on the tile upstream of the machine and serves to select the correct pattern (of the various patterns which might be reproduced on the silk screen roll) to apply on that specific tile 2.

The identification code reading, plus the cylinder angle position reading constitute the reference data forming the basis of the information whereby the automatic control performs synchronisation between the transfer cylinder 5 and the tile 2 gripped between the branches 17 and 17' for a correct application of the decoration on the tiles 2. On the basis of the above-mentioned data, the command unit (processing unit) 30, following the specific set program, brings the transfer cylinder 5 to the correct speed to correspond with the transiting tile 2 and the matrix-bearing cylinder 4. As there is mechanical contact between the transfer cylinder 5 and the matrix-bearing cylinder 4, even where there are changes in speed, these will have no effect on the rapport between the two cylinders 5 and 4.

Obviously, the tile 2 stays gripped between the opposite branches 17 and 17' at least during the period of contact with the external surface of the transfer cylinder 5. The number of decorations the machine can apply corresponds to the number of images made on the silk screen.

In order for the above operation to be carried out, it is never necessary to stop the machine, which results in an improved work rate with respect to traditional work methods.

The perfect synchronizability of the translation movement of the tile 2 on the rest plane 1 and the angle of the transfer cylinder 5 so that the decoration can be transferred perfectly means that several machines can be positioned in series along a same tile conveyor 3 so that several decorations (applications of glaze) can be made on a same tile, all perfectly centered.

For example, the various patterns on a cylinder 4 can contain one very simple non-pattern, that is a tract which deposits on the tile 2 a uniform single glaze coating in a specific color. Thus the machine can function simply as a glazing machine.

What is claimed:

1. An apparatus for glazing and decorating ceramic tiles, comprising:

a tile conveyor;

a rest plane for transporting tiles, said rest plane being in line with the tile conveyor;

a rotary glazing and decorating machine positioned above the rest plane and comprising a matrix-bearing cylinder coupled on an underlying transfer cylinder predisposed such that an external cylindrical surface thereof at least partially contacts an upper surface of the tiles;

a gripping and transport device of the tiles situated such as to project superiorly with respect to the rest plane and to be below the transfer cylinder; the gripping and transport device comprising two belts exhibiting two branches, positioned diametrically opposite one to another with respect to a tile advancement direction and predisposed to contact opposite lateral edges thereof and adhere thereto by friction force; said branches being speed-synchronized in the tile advancement direction;

a sensor disposed above the conveyor for signaling when a tile gripped between the branches has reached a predetermined position on the rest plane; and means for synchronizing a rotation of at least the transfer cylinder with a translation of the branches gripping the tiles, said means for synchronizing being coupled to the transfer cylinder and the gripping and transport device.

2. The Apparatus as in claim 1, comprising:

a code reading device disposed beneath the tile conveyor for reading an identification code provided on each of the tiles;

a device for reading an angular position of the transfer cylinder when the sensor has signalled a presence of a tile, the device being rotatably coupled to the transfer cylinder;

said identification code reading and the reading an angular position of the transfer cylinder together constituting reference data whereby the transfer cylinder, through a variation in speed effected before the contact with the tile, is synchronized with the advancement direction of the tile gripped between the branches of the belts.

3. The apparatus according to claim 1, wherein the matrix-bearing cylinder comprises a cylindrical silk screen free of welding and ribbing and provided with an internal device for forcing glaze externalwise of the matrix-bearing cylinder.

4. The apparatus according to claim 1, wherein the transfer cylinder comprises a roller having an external wear-resistant coating predisposed on an underlying layer of elastomer.

5. The apparatus according to claim 1, comprising a doctor which contacts the external surface of the transfer cylinder at a prefixed pressure and which alternates in a parallel direction to the axis of the transfer cylinder.

6. The apparatus according to claim 1, wherein the transfer cylinder is mechanically connected in rotation with the matrix-bearing cylinder and is driven by a step-by-step motor.

7. The apparatus according to claim 1, wherein the belts are looped and cogged, and coupled on cogged pulleys, and driven by step-by-step motors.

* * * * *